US005524807A

United States Patent [19]

Bullard

[11] Patent Number: 5,524,807

[45] Date of Patent: Jun. 11, 1996

[54] FASTENER TOOL

[76] Inventor: Robert Bullard, P.O. Box 7152, Charlotte, N.C. 28241

[21] Appl. No.: 348,591

[22] Filed: Dec. 2, 1994

[51] Int. Cl.[6] ..... B25C 1/04

[52] U.S. Cl. ..... 227/109; 227/130; 227/156; 227/148

[58] Field of Search ..... 227/109, 78, 56, 227/156, 148, 30, 130, 110; 29/243.523, 798

[56] References Cited

U.S. PATENT DOCUMENTS

| | | | |
|---|---|---|---|
| 3,402,869 | 9/1968 | Otis . | |
| 3,815,475 | 6/1974 | Howard et al. . | |
| 3,871,566 | 3/1975 | Elliesen et al. . | |
| 4,026,453 | 5/1977 | Davidson et al. | 227/109 |
| 4,117,767 | 10/1978 | Elliesen . | |
| 4,288,016 | 9/1981 | Failla et al. . | |
| 4,610,381 | 9/1986 | Kramer et al. . | |
| 4,938,408 | 7/1990 | Bedi et al. . | |
| 4,989,438 | 2/1991 | Simon . | |
| 5,056,930 | 11/1991 | Kennedy | 227/130 |
| 5,191,706 | 3/1993 | Cosden | 29/798 |

*Primary Examiner*—Rinaldi I. Rada
*Assistant Examiner*—Allan M. Schrock
*Attorney, Agent, or Firm*—W. Thad Adams, III

[57] ABSTRACT

A fastener tool is provided for attaching a protective strip to a corner formed by two intersecting walls. The fastener tool includes a handle for being gripped by a user. First and second fastener guns are supported by the handle at a predetermined angle in relation to each other and to the intersecting walls. The first and second fastener guns drive respective fasteners into the protective strip and intersecting walls thereby attaching the strip to the corner. A trigger mechanism is connected to the handle for actuating the first and second fastener guns.

12 Claims, 4 Drawing Sheets

FASTENER TOOL

TECHNICAL FIELD AND BACKGROUND OF THE INVENTION

This invention relates to a fastener tool. The invention is particularly useful by dry wallers for applying a corner bead to a corner formed by two intersecting walls. The corner bead is a relatively narrow strip of metal or plastic formed at a right angle, and attached to the sheet rock of the intersecting walls before plastering. The corner bead defines the outside edge of the wall corner, and serves to protect the edge from chipping and cracking. The corner bead is typically attached to the wall corner by fasteners, such as nails or staples.

Dry wallers commonly use a standard compressed-air powered staple gun or nail gun to drive the fasteners into each outer side of the corner bead and intersecting walls. To properly attach the corner bead, the user drives one fastener into an outer side of the corner bead and first wall, and then shifts the fastener gun to the other wall to drive a second fastener into the opposite outer side of the corner bead and second wall. This procedure is repeated throughout the entire length of the corner bead until a generally equal number of fasteners are applied to each wall and each outer side of the corner bead. Use of the standard, prior art fastener gun in this manner is time consuming and inefficient. Mistakes and misfiring frequently occur in an attempt to speed up this process.

The present invention addresses these and other limitations of prior art fastener guns by providing a tool which includes two fastener guns mounted perpendicular to each other for simultaneously driving fasteners into each outer side of the corner bead and intersecting walls without shifting the tool between the adjacent walls. By moving the invention vertically along the length of the corner bead and actuating a trigger mechanism, the user can properly attach the corner bead in a fraction of the time required using conventional tools. Moreover, since the invention does not require shifting between adjacent walls, the user expends much less energy, and is less likely to make mistakes or misfires.

SUMMARY OF THE INVENTION

Therefore, it is an object of the invention to provide a fastener tool for applying a protective strip to a corner formed by two intersecting walls.

It is another object of the invention to provide a fastener tool which properly attaches the protective strip to the wall corner with a single vertical pass of the tool along the wall corner.

It is another object of the invention to provide a fastener tool which properly attaches the protective strip to the wall corner without shifting the tool between the adjacent, intersecting walls.

It is another object of the invention to provide a fastener tool which reduces user mistakes and misfiring of fasteners as the protective strip is applied to the wall corner.

It is another object of the invention to provide a fastener tool for attaching the protecting strip in a more efficient manner relative to that of conventional tools.

These and other objects of the present invention are achieved in the preferred embodiments disclosed below by providing a fastener tool for attaching a protective strip to a corner formed by two intersecting walls. The fastener tool includes a handle for being gripped by a user. First and second fastener driver means are supported by the handle at a predetermined angle in relation to each other and to the intersecting walls. The first and second fastener driver means drive respective fasteners into the protective strip and intersecting walls thereby attaching the strip to the corner. Trigger means is connected to the handle for actuating the first and second fastener driver means.

According to one preferred embodiment of the invention, the first and second fastener driver means are disposed substantially perpendicular to each other for inserting fasteners into the protective strip and intersecting walls.

According to another preferred embodiment of the invention, a mounting shoe is connected to the handle and the first and second fastener driver means for engaging the protective strip and holding the protective strip against the corner as the fasteners are applied to the protective strip and intersecting walls.

According to yet another preferred embodiment of the invention, the mounting shoe is an angled segment of substantially L-shaped cross-section.

According to yet another preferred embodiment of the invention, the first and second fastener driver means include respective magazines for storing fasteners. Each of the magazines are attached to the mounting shoe.

According to yet another preferred embodiment of the invention, the first and second fastener driver means are first and second compressed-air actuated fastener guns.

Preferably, the fastener gun is a compressed-air actuated staple gun.

According to another preferred embodiment of the invention, the handle includes a hollow grip section communicating with a source of compressed air. A hollow cross member is connected to the grip section for directing the compressed air into respective chambers of the first and second fastener guns.

According to yet another preferred embodiment of the invention, firing means located in respective chambers is actuated by the trigger means, and operates to fire the respective fastener guns.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
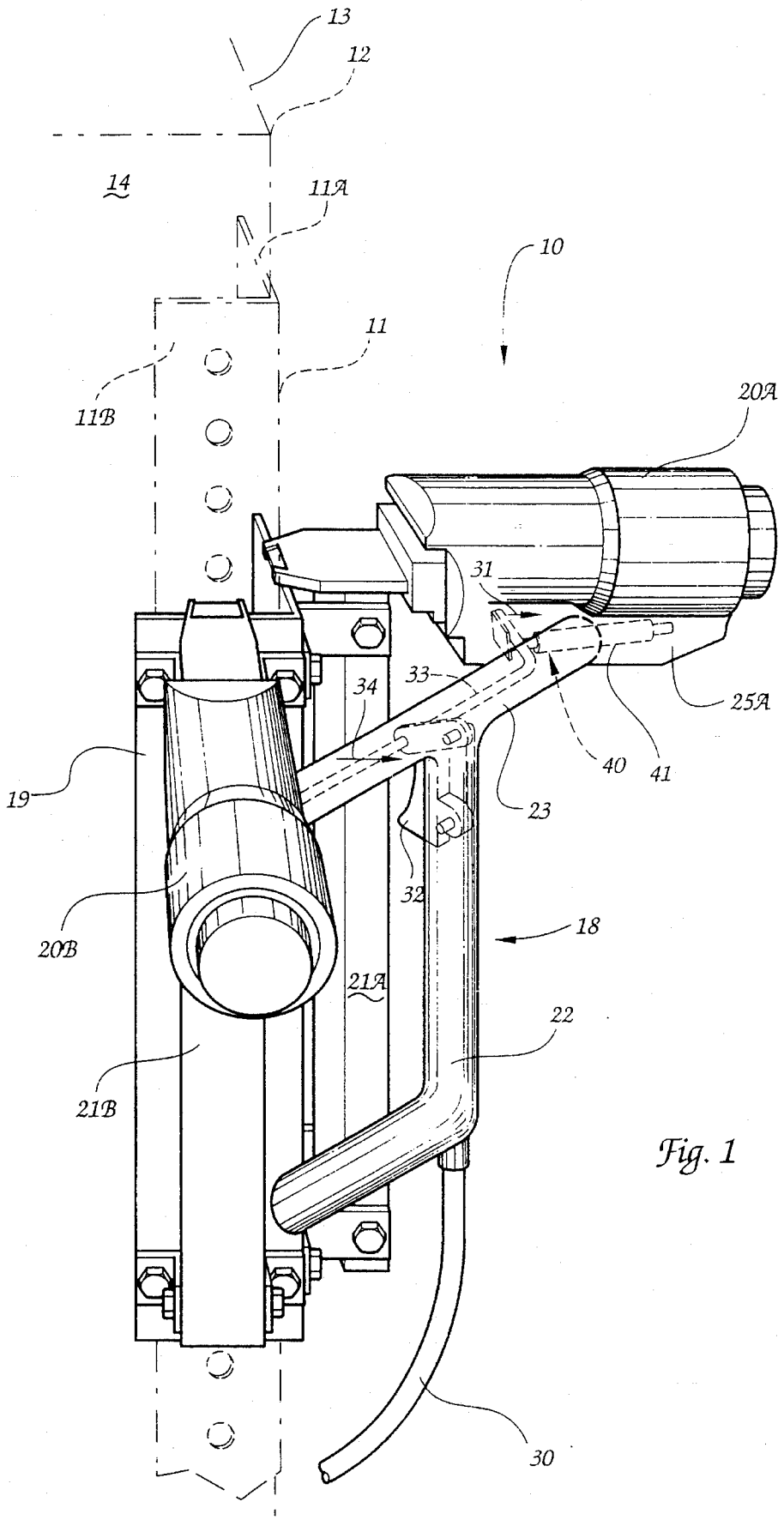
FIG. 1 is a perspective view of the fastener tool according to one preferred embodiment of the invention, and showing the linkage assembly in phantom for causing the fastener guns to fire.
Figure 2:
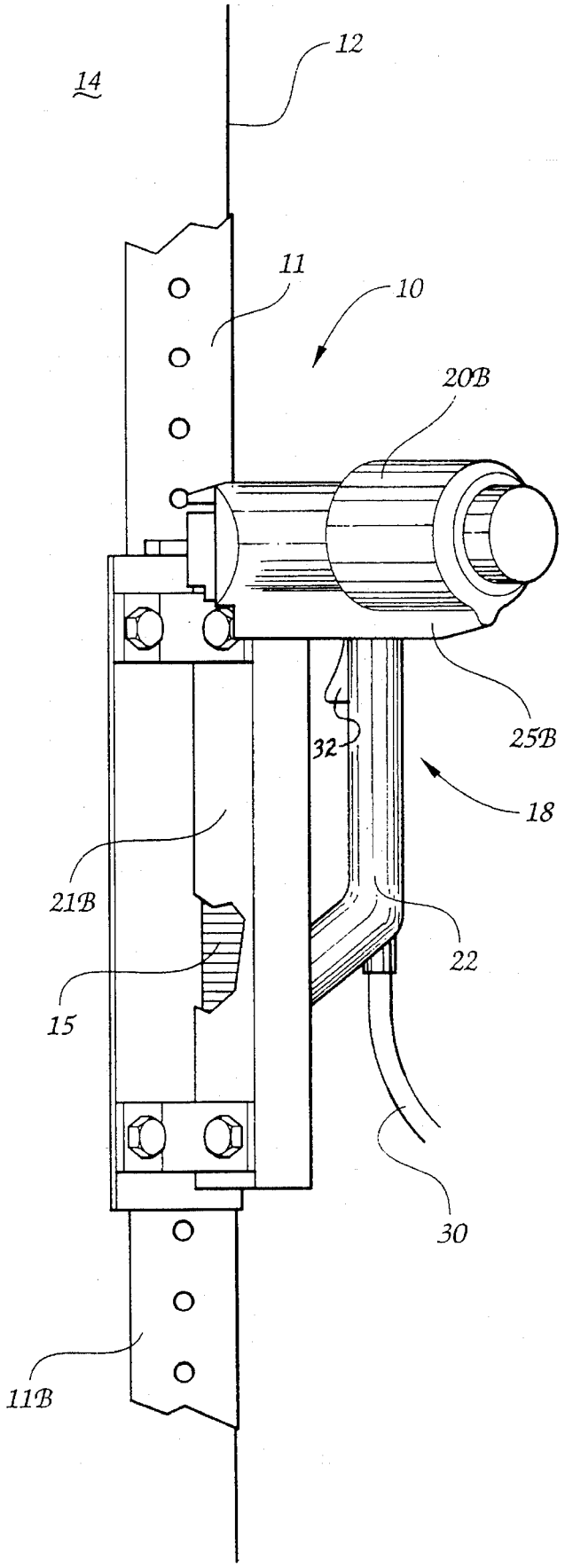
FIG. 2 is a side elevational view of the fastener tool showing the corner bead applied to the wall corner.
Figure 3:
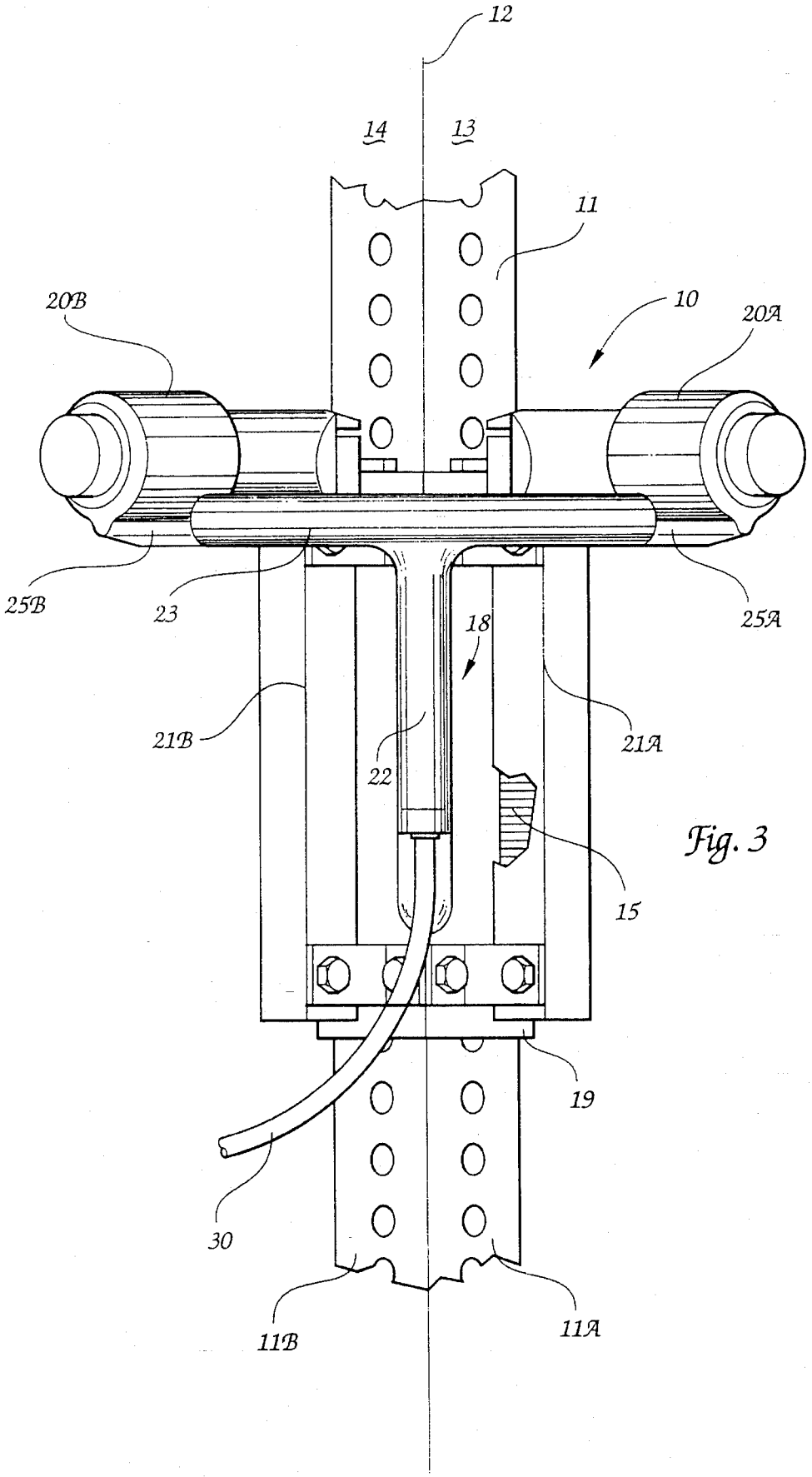
FIG. 3 is a back elevational view of the fastener tool showing the corner bead applied to the wall corner.

Referring now specifically to the drawings, a fastener tool according to the present invention is illustrated in FIG. 1 and shown generally at reference numeral 10. The fastener tool 10 is particularly useful by dry wallers for applying a protective strip, such as a metal corner bead 11, to the outside edge of a corner 12 formed by two adjacent, intersecting walls 13 and 14 of sheet rock. The corner bead 11 is applied to the wall corner 12 before plastering by driving fasteners 15 (See FIGS. 2 and 3), such as staples or nails, into the corner bead 11 and walls 13 and 14. The fasteners 15 are inserted into each outer side 11A and 11B of the corner bead 11 and the adjacent walls 13 and 14 to ensure proper attachment of the corner bead 11 to the wall corner 12.

Figure 4:
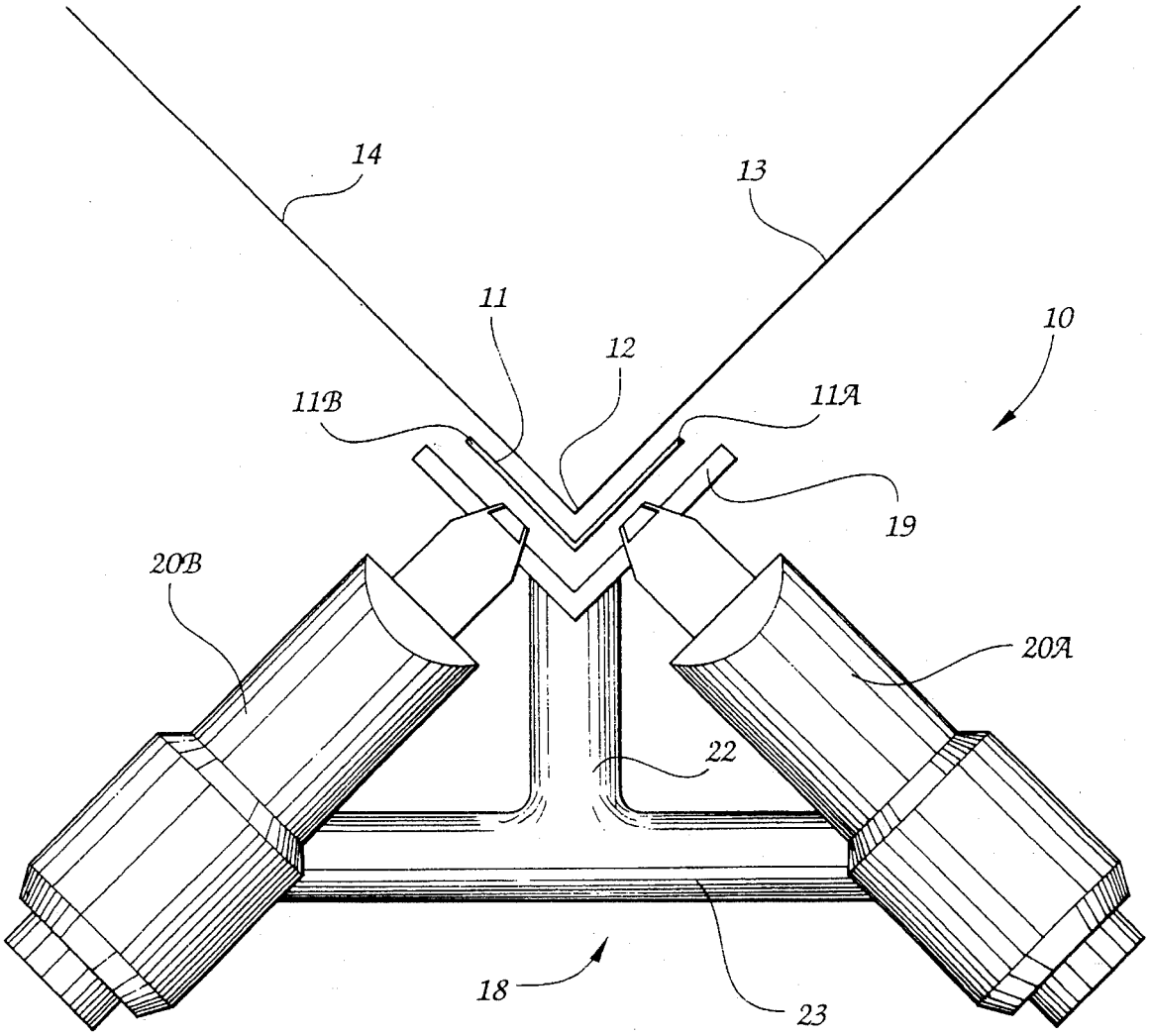
FIG. 4 is a top plan view of the fastener tool showing the fastener tool and corner bead slightly spaced apart from the wall corner for clarity.

As shown in FIGS. 1–4, the fastener tool 10 includes a handle 18, a mounting shoe 19, and first and second compressed-air or gas powered fastener guns 20A and 20B. The fastener guns 20A and 20B may be either staple guns or nail guns commonly known and used in the art. As best shown in FIGS. 1 and 4, the fastener guns 20A and 20B are connected to the handle 18 and mounting shoe 19 in perpendicular relation to each other for simultaneously driving fasteners 15 into the outer sides 11A and 11B of the corner bead 11 and intersecting walls 13 and 14. The fastener guns 20A and 20B include respective magazines 21A and 21B for storing the fasteners 15. The magazines 21A and 21B are connected to the mounting shoe 19 by bolts, welding, or other suitable means.

According to one embodiment, the mounting shoe 19 forms a substantially 90 degree angle to fit adjacent the outside edge of the wall corner 12. The mounting shoe 19 acts to hold the corner bead 11 in position, and to align the fastener guns 20A and 20B such that the fasteners 15 are properly driven into the corner bead 11 and intersecting walls 13 and 14. In an alternative embodiment, a mounting shoe can be shaped to fit against a soft or curved wall corner, and may also include a crimper (not shown) for shaping the corner bead prior to attachment to fit the particular wall corner.

As best shown in FIG. 1, the handle 18 of the fastener tool 10 includes a hollow grip section 22 and a communicating hollow cross member 23 joined to the grip section 22. The cross member 23 is joined at opposite ends to respective chambers 25A and 25B of the first and second fastener guns 20A and 20B. The grip section 22, cross member 23, and chambers 25A and 25B are fluidly connected together for receiving and containing compressed air.

An air supply hose 30 is attached to the grip section 22, and communicates with a source of compressed air for injecting compressed air into the hollow grip section 22, cross member 23, and chambers 25A and 25B. The air supply hose 30 and compressed air source provide the required air pressure necessary to operate each of the fastener guns 20A and 20B.

A trigger mechanism 32 is located on the grip section 22 of the handle 18 for being depressed by a user to simultaneously fire each of the fastener guns 20A and 20B. As shown in FIG. 1, when the trigger mechanism 32 is depressed, a linkage assembly 33 actuates respective firing means 40 of the fastener guns 20A and 20B.

The term "firing means" is defined herein as the critical interior element (or elements) of the compressed-air powered fastener gun which is actuated by the trigger mechanism in order to fire the gun. The firing means may be any such means employed by conventional fastener guns of the prior art.

According to one embodiment, the firing means 40 includes a valve rod 41 actuated by the trigger mechanism 32 when the trigger mechanism 32 is depressed. Although only the valve rod 41 is shown, it is understood that an identical valve rod operating in an identical manner is located in the chamber 25B of the fastener gun 20B. When actuated, each valve rod 41 moves as indicated at 31, and cooperates with an assembly of interior O-rings and valves (not shown) to direct a burst of compressed-air from the respective chambers 25A and 25B to drive the fasteners 15 into the corner bead 11 and walls 13 and 14. Such firing means 40 is common in the art, and has been employed in compressed-air powered fastener guns such as that disclosed in U.S. Pat. Nos. 3,871,556 and 4,117,767. Alternative gun firing means are disclosed in U.S. Pat. Nos. 3,815,475 and 3,106,136. The complete disclosure and teachings of each of these prior patents are incorporated herein by reference.

With regard to FIG. 1, when the trigger mechanism 32 is depressed, the linkage assembly 33 moves as indicated by the direction arrow 34 to actuate in unison the respective valve rods 41 of the fastener guns 20A and 20B. The actuated valve rods 41 cause the fastener guns 20A and 20B to fire simultaneously with sufficient force to drive the fasteners 15 into the corner bead 11 and intersecting walls 13 and 14.

As will be appreciated by those of skill in the art, the particular means of firing the fastener guns 20A and 20B is not critical to the invention. Consequently, the linkage assembly 33 may include any structure operable to actuate the firing means 40 of the fastener guns 20A and 20B when the trigger mechanism 32 is depressed.

In an alternative embodiment (not shown), the fastener tool may simply include two conventional fastener guns connected to a mounting shoe by suitable brackets or welding. Each fastener gun includes a separate compressed-air supply source and trigger mechanism. Thus, instead of firing the fastener guns simultaneously with a single trigger mechanism, as described above, the user would depress the trigger mechanism of each gun to drive the fasteners into the opposing sides of the corner bead and intersecting walls. The fastener tool of this embodiment may further include a center handle welded to the mounting shoe for allowing the user to hold the tool against the wall corner with one hand while depressing the trigger mechanism of each fastener gun with the other hand.

A fastener tool is described above. Various details of the invention may be changed without departing from its scope. Furthermore, the foregoing description of the preferred embodiment of the invention is provided for the purpose of illustration only and not for the purpose of limitation—the invention being defined by the claims.

I claim:

1. A fastener tool for attaching a protective strip to an outside edge of a corner formed by two intersecting walls, said fastener tool comprising:

(a) a handle for being gripped by a user;

(b) first and second fluid actuated fastener guns for driving respective fasteners into the protective strip and intersecting walls thereby attaching the strip to the corner, said first and second fastener guns being supported by said handle at a predetermined angle in relation to each other and to the intersecting walls;

(c) said handle including a hollow grip section communicating with a source of fluid, and a hollow cross member connected to the grip section for directing the fluid into respective chambers of the first and second fastener guns; and (d) trigger means connected to said handle for actuating said first and second fastener guns.

2. A fastener tool according to claim 1, wherein said first and second fastener guns are disposed substantially perpendicular to each other for inserting fasteners into the protective strip and intersecting walls.

3. A fastener tool according to claim 2, and including a mounting shoe connected to said handle and said first and second fastener guns for engaging the protective strip and holding the protective strip against the corner as the fasteners are applied to the protective strip and intersecting walls.

4. A fastener tool according to claim 3, wherein said mounting shoe comprises an angled segment of substantially L-shaped cross-section.

5. A fastener tool according to claim 3, wherein said first and second fastener guns include respective magazines for storing fasteners, each of said magazines being attached to the mounting shoe.

6. A fastener tool according to claim 1, wherein said fastener guns is a compressed-air actuated staple guns.

7. A fastener tool according to claim 1, and including firing means located in respective chambers for being actuated by said trigger means to fire the respective fastener guns.

8. A fastener tool for attaching a protective strip to an outside edge of a comer formed by two intersecting walls, said fastener tool comprising:

(a) a handle for being gripped by a user;

(b) first and second compressed-air actuated fastener guns for driving respective fasteners into the protective strip and intersecting walls thereby attaching the strip to the corner, said first and second fastener guns being supported by said handle at a predetermined angle in relation to each other and to the intersecting walls;

(c) said handle including a hollow grip section communicating with a source of compressed air, and a hollow cross member connected to the grip section for directing the compressed air into respective chambers of the first and second fastener guns;

(d) a mounting shoe connected to said handle and said first and second fastener guns for engaging the protective strip and holding the protective strip against the corner as the fasteners are applied to the protective strip and intersecting walls; and (e) trigger means connected to said handle for actuating said first and second fastener guns.

9. A fastener tool according to claim 8, wherein said mounting shoe comprises an angled segment of substantially L-shaped cross-section.

10. A fastener tool according to claim 8, wherein said first and second fastener guns include respective magazines for storing fasteners, each of said magazines being attached to the mounting shoe.

11. A fastener tool according to claim 8, wherein said fastener guns is a compressed-air actuated staple guns.

12. A fastener tool according to claim 8, and including firing means located in respective chambers for being actuated by said trigger means to fire the respective fastener guns.

* * * * *